US010845025B2

(12) United States Patent
Crompvoets et al.

(10) Patent No.: US 10,845,025 B2
(45) Date of Patent: Nov. 24, 2020

(54) LIGHTING ASSEMBLY WITH DIFFUSOR

(71) Applicant: Lumileds LLC, San Jose, CA (US)

(72) Inventors: Floris Maria Hermansz Crompvoets, Bunde (NL); Christian Kleijnen, Ell (NL); Ralph Hubert Peters, Kerkrade (NL); Adam Lind, Aldenhoven (NL); Rob Bastiaan Maria Einig, Aldenhoven (DE)

(73) Assignee: LUMILEDS LLC, San Jose, CA (US)

( * ) Notice: Subject to any disclaimer, the term of this patent is extended or adjusted under 35 U.S.C. 154(b) by 0 days.

(21) Appl. No.: 16/336,287

(22) PCT Filed: Sep. 15, 2017

(86) PCT No.: PCT/EP2017/073322
§ 371 (c)(1),
(2) Date: Mar. 25, 2019

(87) PCT Pub. No.: WO2018/059973
PCT Pub. Date: Apr. 5, 2018

(65) Prior Publication Data

US 2019/0277476 A1 Sep. 12, 2019

(30) Foreign Application Priority Data

Sep. 29, 2016 (EP) ..... 16191317

(51) Int. Cl.
*F21V 3/06* (2018.01)
*F21S 4/28* (2016.01)
(Continued)

(52) U.S. Cl.
CPC ..... *F21V 3/0625* (2018.02); *F21K 9/65* (2016.08); *F21S 4/22* (2016.01); *F21S 4/28* (2016.01);
(Continued)

(58) Field of Classification Search
CPC . F21V 3/0625; F21V 3/062; F21S 4/28; F21S 4/20; F21S 4/22; F21S 4/24;
(Continued)

(56) References Cited

U.S. PATENT DOCUMENTS 6,846,098 B2 * 1/2005 Bourdelais ..... G02B 5/0221 359/599
9,039,222 B2 * 5/2015 Chang ..... G02B 6/0011 362/612
(Continued)

FOREIGN PATENT DOCUMENTS

EP 1028347 A1 8/2000
JP 2013196847 A 9/2013
(Continued)

OTHER PUBLICATIONS

Heinrich Dr Noll, "Diffusion Plate with Variable Thickness", Aug. 16, 2000, Espacenet—Feb. 7, 2020 Patent Translate Powered by EPO and Google, EP 1028348 A1, Description EP1028348 pp. 1-6 and Figures 1-2.*
(Continued)

*Primary Examiner* — Alan B Cariaso
(74) *Attorney, Agent, or Firm* — Volpe Koenig

(57) ABSTRACT

A lighting assembly includes at least two LED elements arranged at a distance from each other. A diffusor element extends over the LED lighting elements. The diffusor element comprises first diffusion portions arranged in front of the LED lighting elements and second diffusion portions arranged in between the first diffusion portions. The first diffusion portions are disposed to cause a stronger optical diffusion than the second diffusion portions, thereby providing a more homogeneous appearance of light emitted from the diffusor element.

13 Claims, 3 Drawing Sheets

(51) Int. Cl.

| | |
|---|---|
| ***F21K 9/65*** | (2016.01) |
| ***F21S 4/22*** | (2016.01) |
| ***F21Y 103/10*** | (2016.01) |
| ***F21Y 115/10*** | (2016.01) |

(52) U.S. Cl.
CPC ..... *F21Y 2103/10* (2016.08); *F21Y 2115/10* (2016.08)

(58) Field of Classification Search
CPC ..... F21S 4/26; F21K 9/65; G02F 1/133606; G02F 2001/133607; F21Y 2103/10
See application file for complete search history.

(56) References Cited

U.S. PATENT DOCUMENTS

| | | | | |
|---|---|---|---|---|
| 9,121,981 | B2 * | 9/2015 | Kim | G02B 6/0021 |
| 9,897,266 | B2 * | 2/2018 | Moon | G02B 6/0055 |
| 2004/0168359 | A1 * | 9/2004 | Cleaver | F21K 9/00 40/547 |
| 2005/0036310 | A1 | 2/2005 | Fan | |
| 2010/0124047 | A1 * | 5/2010 | Ahn | G02B 5/02 362/97.3 |
| 2010/0265694 | A1 * | 10/2010 | Kim | G02B 6/0021 362/97.1 |
| 2011/0261290 | A1 * | 10/2011 | Kim | G02B 6/0021 349/64 |
| 2012/0057336 | A1 * | 3/2012 | Farmer | F21V 5/00 362/223 |
| 2014/0159562 | A1 | 6/2014 | Streppel et al. | |
| 2016/0348852 | A1 * | 12/2016 | Kaandorp | F21V 13/04 |
| 2016/0356454 | A1 * | 12/2016 | Camarota | F21V 7/005 |

FOREIGN PATENT DOCUMENTS

| | | | |
|---|---|---|---|
| WO | 01/84595 | A1 | 8/2001 |
| WO | 2008/025909 | A1 | 3/2008 |

OTHER PUBLICATIONS

Sakurai et al., "LED Lamp", Sep. 30, 2013, Publication No. JP 2013196847A English translation, Detail Description paragraphs 0001-0096 and FIGs.1-22.*

Mulet et al., "Optical System for Lighting Device, Lighting Device and Method of Controlling the Device", Mar. 6, 2008, Espacenet Patent Translate Powered by EPO and Google, WO 2008/025909 A1, Description WO2008025909 pp. 1-20 and Figures 1a-7.*

* cited by examiner

LIGHTING ASSEMBLY WITH DIFFUSOR

FIELD OF THE INVENTION

The invention relates to the field of lighting, and more specifically to a lighting assembly.

BACKGROUND OF THE INVENTION

LEDs are used today for an increasing number of lighting applications due to advantageous properties such as high energy efficiency, compact size and long lifetime. However, while many lighting applications require light output to be spread over a larger area, the light output from LEDs is rather concentrated to small areas. If a plurality of LEDs is used, these are generally arranged at a certain distance from each other due to thermal limitations and for cost reasons.

In order to obtain a relatively homogeneous light output from a plurality of LEDs, it is generally known to position a diffusor element in front of the LEDs. However, the arrangement of individual LEDs behind the diffusor is still visible in many cases, such that the light output over the front surface of the diffusor is not very homogeneous, leading to a spotty appearance. While a very thick diffusor may achieve better homogeneity, this will lead to reduced overall efficiency.

JP 2013 196847 A discloses an LED lamp with LEDs provided at a substrate in a glass tube. A diffusion reflection part is formed on the circumference of the glass tube. The width of the diffusion reflection part in circumference direction varies throughout the longitudinal direction of the glass tube.

EP 1 028 348 A1 discloses an arrangement for producing a uniform illumination from a light source, for a surface to be illuminated, comprising a light source located behind a screen. The screen thickness varies over the surface cross section.

WO 2008/025909 A1 discloses an optical system comprising a diffuser for a homogenized luminance output.

SUMMARY OF THE INVENTION

It could be considered an object to provide a lighting assembly for achieving a more homogeneous appearance, in particular with a compact arrangement.

This is achieved by the lighting assembly according to claim 1. Dependent claims refer to preferred embodiments.

According to the invention, at least two LED lighting elements are provided. The term "LED lighting elements" should be understood to cover any known type of solid state lighting element, such as e.g. light emitting diodes, organic light emitting diodes, laser diodes, etc. Each LED lighting element may comprise one or a plurality of such components arranged in proximity. For example, one LED lighting element may comprise two or more dies of light emitting diodes. In particular, it is possible to provide light emitting diodes of different color placed in proximity, such as e.g. in an RGB LED. The LED lighting elements may be individually packaged components, i.e. they may comprise individual housings with electrical terminals. Also, it is possible to provide the LED lighting elements as pure unpackaged LED dies, e.g. connected directly to a leadframe.

The lighting assembly comprises at least two LED lighting elements, but a larger number is preferred, such as at least 3, 4 or 5, further preferably e.g. more than 10. The LED lighting elements are arranged at a distance from each other. While this is not required, a plurality of LED elements may be equally spaced. In particular, a plurality of LED lighting elements may be arranged in a line, e.g. equidistant according to a constant pitch.

The lighting assembly according to the invention further comprises a diffusor element extending over the LED lighting elements, i.e. being arranged such that light therefrom is emitted into the direction of the diffusor element. The diffusor element is translucent but not entirely transparent, i.e. light traversing the diffusor element is scattered. For example, the diffusor element may comprise diffusion particles embedded in a transparent or translucent material, such as, for example, $TiO_2$ particles dispersed in transparent.

The inventors have considered that the light input from two or more LED lighting elements arranged at a distance from each other is inhomogeneous. Thus, in order to achieve a more homogeneous output from a top surface of the diffusor element, the optical properties of the diffusor element could be chosen non-homogeneous in order to counteract and compensate for the non-homogeneous light input. By a suitable choice of non-homogeneous optical properties of the diffusor element, light output may thus be homogenized.

Accordingly, the diffusor element may be comprised of different diffusion portions providing different levels of optical diffusion in different locations. In the most basic configuration, at least two types of diffusion portions may be provided with different levels of diffusion. First diffusion portions may be arranged in front of the LED lighting elements, and at least one second diffusion portion may be arranged in between the first diffusion portions. The first diffusion portions are disposed to cause stronger optical diffusion than the second diffusion portion.

Embodiments of a lighting assembly including such a non-homogeneous diffusor element with first and second diffusion portions have proven to provide a significantly homogenized light output as compared to a homogeneous diffusor element. A definition of the most preferred, fully homogeneous appearance would be a lambertian type emission of light from the surface with fully uniform luminance, i.e. no spatial variation. For practical embodiments of a light emitting surface, a homogeneity value may be defined as the standard deviation of the luminance values over the surface area divided by the mean luminance value over the surface area. Homogeneity values of e.g. 50%, preferably 40% or less may be regarded satisfactory for some applications. Values of 25% or less are preferred; especially preferred are values of 10% or less, which are generally perceived as fully homogeneous.

In particular, satisfactory homogeneity values were obtained with the current invention already with a relatively thin diffusor element, thus maintaining high efficiency.

The lighting assembly according to the invention is especially suited to provide line-shaped illumination, in particular in very compact assemblies. A plurality, or all, of the LED lighting elements may be arranged in a line. One or more diffusor elements may be provided to cover the LED lighting elements, being arranged such that first diffusion portions are each positioned in front of the LED lighting elements. Consequently, second diffusion portions may be arranged in between the LED lighting elements.

While in principle an improvement in the homogeneity of the light output may be achieved with a stepwise variation of the level of optical diffusion changing between the first and second diffusion portions (with optionally intermediate portions in between), this is not preferred since steps may be visible in the luminance appearance. Therefore, it is generally preferred to provide a diffusor element where the level of optical diffusion varies continuously between the first and second diffusion portions. Preferably, the level of optical diffusion decreases monotonously from the first diffusion portions to the second diffusion portions.

According to one embodiment, the diffusor element comprises diffusion particles embedded in a transparent or translucent material. In order to achieve the different levels of optical diffusion in the first and second diffusion portions (as well as optionally in any intermediate portions), the density of the diffusion particles may vary. The density in the first diffusion portions arranged in front of the LED lighting elements may be higher than the density in the second diffusion portions arranged in between the LED lighting elements.

In a preferred embodiment, the different levels of optical diffusion in the first and second diffusion portions (as well as optionally any intermediate portions arranged in between the first and second diffusion portions) may be achieved by varying the thickness of the diffusor element. The thickness may e.g. be measured perpendicularly to a line or plane in which the LEDs are arranged. The first diffusion portions may be provided with a higher thickness than the second diffusion portions, such that light traversing the diffusor element at the first diffusion portions propagates a longer distance through the diffusor element in the first diffusion portions, thus undergoing stronger diffusion.

A diffusor element of varying thickness may have a constant density of diffusion particles, which is easier to manufacture. However, it is also possible to combine a variation in particle density and a variation in thickness.

Particularly in arrangements of LED elements along a line, the level of optical diffusion of an elongate diffusor element may vary along its length. If the LED elements are arranged at equal distances according to a first pitch, it is advantageous to provide a variation in the level of optical diffusion to be equally periodical with a second pitch equal to the first pitch. For example, the thickness of the diffusor element may vary periodically with the same pitch as the arrangement of the LED lighting elements, and preferably the arrangement of the LED lighting elements and of the thickness are spatially in phase, such that the maxima of the thickness are arranged directly above the LED lighting elements.

In a preferred embodiment, a top surface of the diffusor element may have a plane shape. An opposed bottom surface oriented towards the LED lighting elements may have an undulating shape to obtain varying thickness.

The variation of the thickness of the diffusor element may e.g. be such that first diffusion portions, e.g. corresponding to the maximum thickness, are at least 50% thicker than second diffusion portions, e.g. corresponding to the minimum thickness of the diffusor element. Further preferred, the first diffusion portions are at least 100% thicker than the second diffusion portions.

In preferred embodiments, the LED lighting elements may be arranged with electrical conductors extending between them. In particular, a leadframe may connect the LED lighting elements.

It is further preferred to provide a housing at least partly surrounding the LED lighting elements and the diffusor. The housing may comprise reflective surfaces to improve efficiency. In particular, at least the inner surfaces of the housing oriented towards the LED lighting elements may be reflective. It is particularly preferred for a housing to cover the lateral and bottom surfaces of the lighting assembly, but not the top surface of the diffusor. The housing may be made of a flexible material, e.g. silicone.

The lighting assembly according to the invention is particularly suited to be manufactured with very compact dimensions. For example, the height, e.g. measured from the bottom surface of the lighting assembly to a light emitting top surface of the diffusor may be less than 1 cm, further preferably equal to or less than 8 mm, particularly preferably 5 mm or less. Compared to the pitch of the LED elements, the height may be less than the pitch, preferably correspond to 50% or less of the pitch of the LED elements.

These and other aspects of the invention will be apparent from and elucidated with reference to the embodiments described hereinafter.

DETAILED DESCRIPTION OF EMBODIMENTS

Figure 1:
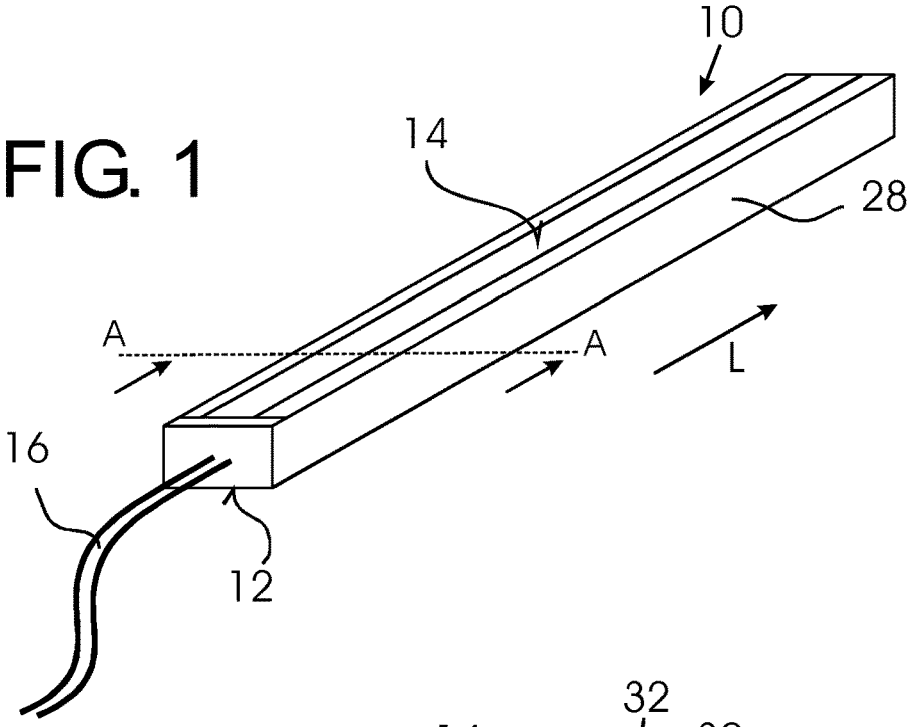
FIG. 1 shows a perspective view of an embodiment of a lighting assembly.

An elongate lighting assembly 10 is shown in FIG. 1, comprising a bottom surface 12 and a top surface 14 from which light is emitted. Electrical connections 16 shown schematically deliver electrical operating power to the lighting assembly 10.

The lighting assembly 10 is of particularly small dimensions, in a preferred example with a height measured from the bottom surface 12 to the top surface 14 of only 4 mm and a width of only 7 mm.

The length in a longitudinal direction L may vary, but will be significantly greater than the width, e.g. at least 10 times greater.

Figure 2:
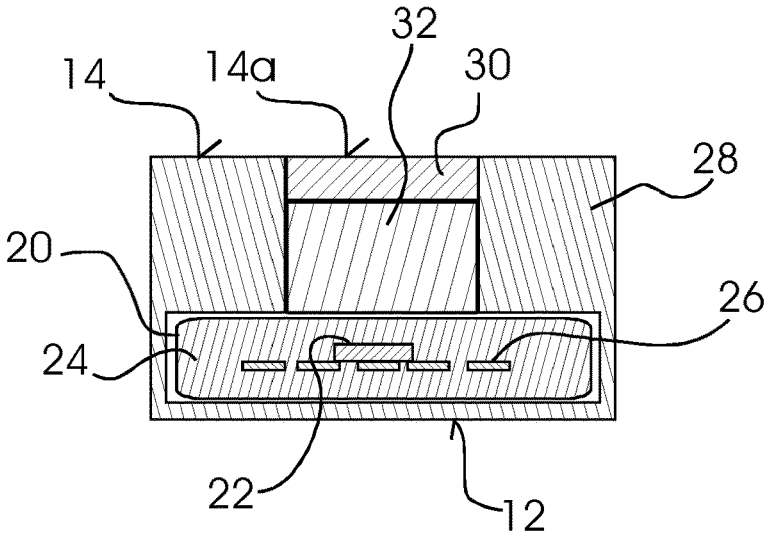
FIG. 2 shows a cross-sectional view of the lighting assembly of FIG. 1 with the section along A . . . A.
Figure 3:
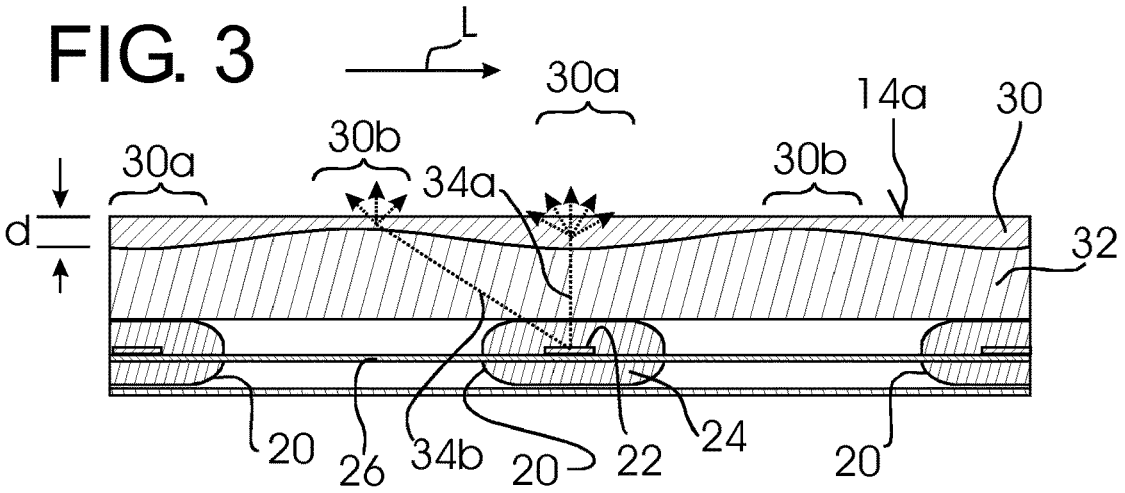
FIG. 3 shows a longitudinal sectional view of the lighting assembly according to FIG. 1, FIG. 2.

In the interior of the lighting assembly 10, as shown in the cross-section of FIG. 2 and longitudinal-section of FIG. 3, a plurality of LEDs 20 are arranged in a line equally spaced along the longitudinal direction L of the lighting assembly 10. In the example shown, each LED 20 comprises a LED die 22 surrounded by a housing 24. The LEDs 20 are electrically interconnected by electrical conductors forming a leadframe 26.

If supplied with electrical operating power, the LEDs 20 are disposed to emit light into the direction of the top surface 14, as schematically shown in dotted lines in FIG. 3. The light from the LEDs 20 is emitted at the top surface 14 through a diffusor 30. The diffusor 30 is made of transparent silicone with dispersed $TiO_2$ particles, such that the light emitted from the LEDs 20 is scattered and emitted as diffuse light from the top surface 14 of the lighting assembly (or more specifically from a top surface 14*a* of the diffusor 30).

The LEDs 20 and the diffusor 30 are enclosed by a housing 28, covering the lateral sides and the bottom of the lighting assembly 10. The inner surfaces of the housing 28 are reflective. The space between the LEDs 20 and the diffusor 30 is filled with a transparent light guide 32, which may be made from silicone.

As shown in FIG. 3, the diffusor 30 has a thickness d which varies along its length L. Thicker diffusor portions 30*a* are arranged directly in front of the LEDs 20, whereas thinner second diffusor portions 30*b* are arranged in between the first diffusor portions 30*a*, thus also in between the LEDs 20.

Figure 4A:
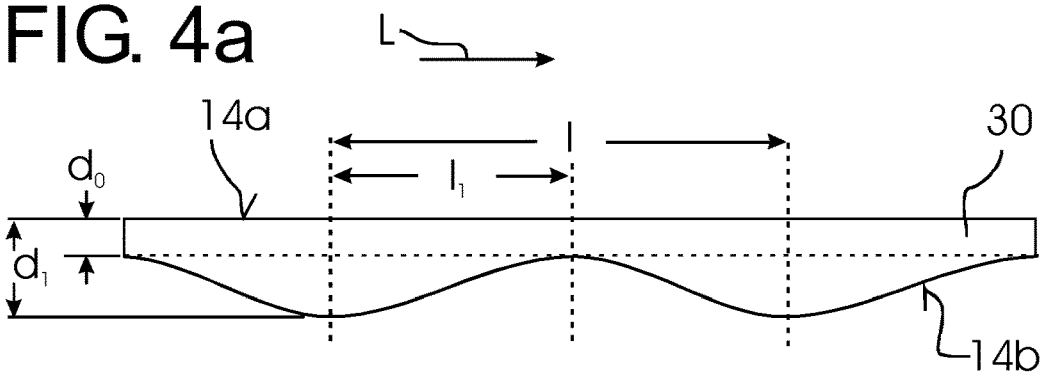
FIG. 4*a*, 4*b* show a side views of different embodiments of diffusors of the lighting assembly according to FIG. 1-FIG. 3.
Figure 5:
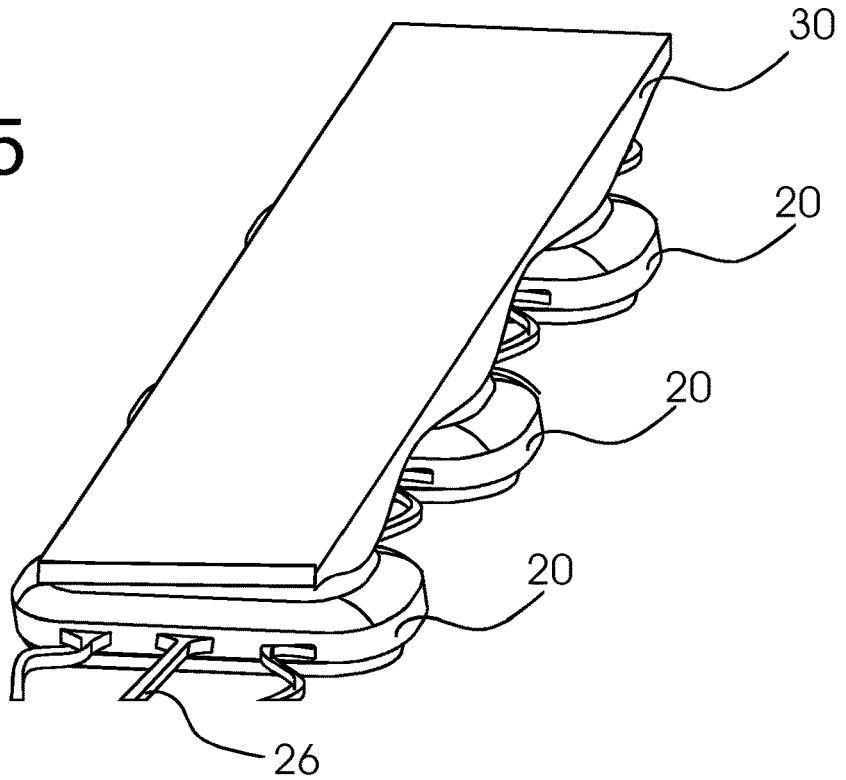
FIG. 5 shows a perspective view of some elements of the lighting assembly according to FIG. 1-3 without a housing.

FIG. 4*a* schematically shows for one embodiment of a diffusor 30 the relevant dimensions. The thickness d varies between a maximum thickness $d_1$ and a minimum thickness $d_0$. The top surface 14*a* is plane, whereas the bottom surface 14*b* is undulating between maxima, corresponding to the first diffusion portions 30*a*, and minima, corresponding to the second diffusion portions 30*b*. In the longitudinal direction L, the distance between the maxima is l, which is equal to the pitch of the arrangement of the LEDs 20. The distance between maxima and minima is $l_1$, which is equal to ½.

Between the maxima and the minima, the thickness d varies continuously in the example shown. For example, the variation may be according to a sine function.

Due to the varying thickness of the diffusor 30, the first diffusion portions 30*a* cause a stronger diffusion effect than the thinner second diffusion portions 30*b*. Since the first diffusion portions 30*a* are arranged directly in front of the light emitting portions of the LEDs 20, the light 34*a* emitted therefrom perpendicular to the plane of the LEDs 20 is strongly diffused, whereas light 34*b* emitted under greater angles towards the second diffusion portions 30*b* undergoes a lower degree of diffusion. Overall, this leads to relatively homogeneous emission of light from the front surface 14*a* of the diffusor 30, i.e. to a uniform luminance.

Figure 4B:
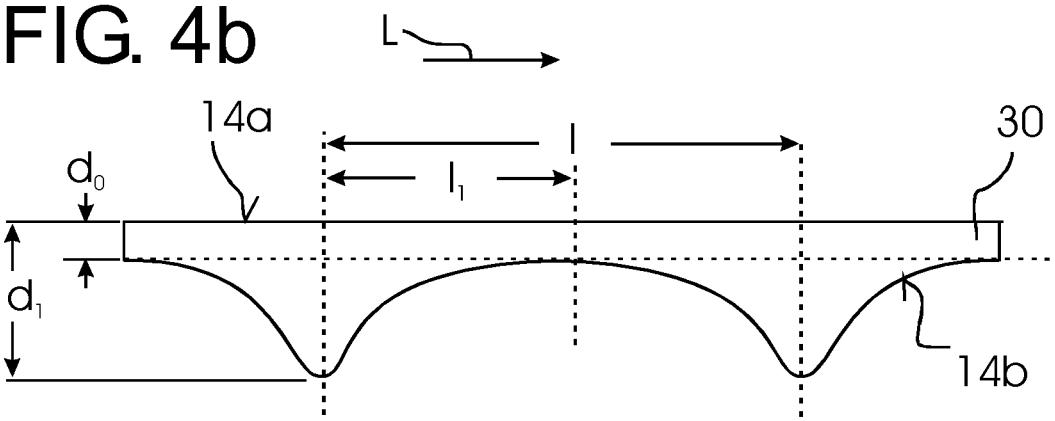

FIG. 4*b* shows a further embodiment of a diffusor 30 with in principle the same shape, but different dimensions. In particular, the ratio $d_1/d_0$ is higher, such that the thickness maxima in this embodiment are steeper and more narrow as compared to the embodiment of FIG. 4*a*.

In specific embodiments, the choice of the exact mathematical function of the thickness variation as well as the choice of dimension parameters $d_0$, $d_1$, and l may depend on the spread of the light emitted from the LEDs 20 as well as the distance between the LEDs 20 and the diffusor 30. The parameters may, for each application, be chosen to obtain the desired homogeneity value.

Figure 6:
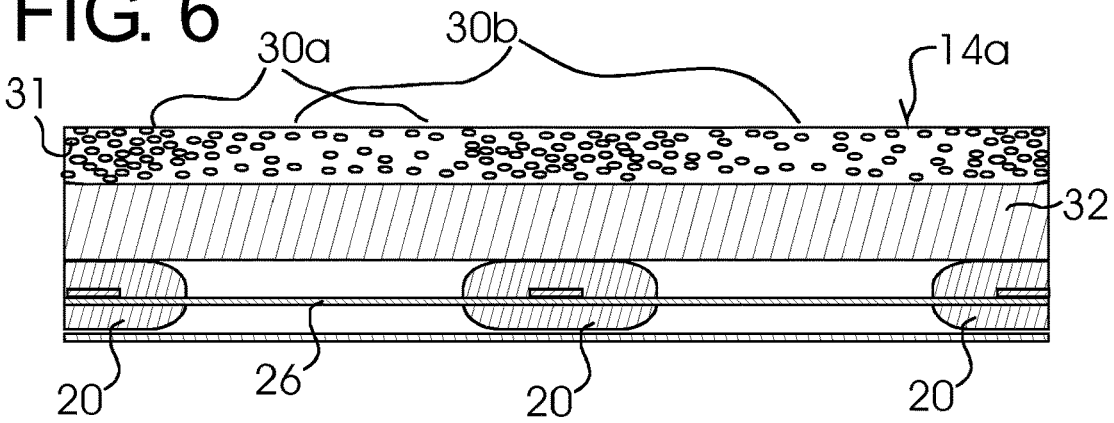
FIG. 6 shows a longitudinal-sectional view of a second embodiment of a lighting assembly.

FIG. 6 shows a longitudinal section of a second embodiment of a lighting assembly, which differs from the above described first embodiment by a different shape of the diffusor 31. In the second embodiment, the diffusor 31 has a constant thickness, but a varying density of diffusion particles (schematically shown in FIG. 6). First diffusion portions 30*a* with a higher density of diffusion particles are arranged directly in front of the LEDs 20, whereas second diffusion portions 30*b* with a lower density of diffusion particles are arranged in between.

Since the level of diffusion caused by the denser diffusion particles in the first diffusion portions 30*a* is stronger than in the second diffusion portions 30*b*, this achieves the same effect of homogenizing the light output as described above.

While the invention has been illustrated and described in detail in the drawings and foregoing description, such illustration and description are to be considered illustrative or exemplary and not restrictive; the invention is not limited to the disclosed embodiments.

For example, while the above embodiments show a constant pitch both for the variations in the diffusor 30 and the placement of the LEDs 20, the arrangement need not in all cases be equidistant, as long as the first diffusion portions 30*a* are arranged in front of the LEDs 20. While the LEDs 20 shown in the above examples are packaged LEDs, it is also possible to use unpackaged LED dies.

Other variations to the disclosed embodiment can be understood and effected by those skilled in the art in practicing the claimed invention, from a study of the drawings, the disclosure and the appended claims.

In the claims, the word "comprising" does not exclude other elements, and the indefinite article "a" or "an" does not exclude a plurality.

The mere fact that certain measures are recited in mutually different dependent claims or embodiments does not indicate that a combination of these measures cannot be used to advantage. For example, it is possible to combine a variation in thickness with a variation in the density of diffusion particles.

Any reference signs in the claims should not be construed as limiting the scope.

The invention claimed is:

1. A lighting assembly, including:

at least two LED lighting elements arranged at a distance from each other with an electrical conductor arranged between the at least two LED lighting elements;

a diffusor element, comprising silicone and dispersive particles, extending over the LED lighting elements, the diffusor element comprising at least first diffusion portions arranged in front of the LED lighting elements and at least one second diffusion portion arranged in between the first diffusion portions, the first diffusion portions being disposed to cause a stronger optical diffusion than the second diffusion portions; and a flexible housing at least partly surrounding the LED lighting elements and the diffusor element.

2. The lighting assembly according to claim 1, wherein a plurality of the LED lighting elements are arranged in a line, the first diffusion portions being each arranged in front of the LED lighting elements.

3. The lighting assembly according to claim 1, wherein the diffusor element is disposed such that a level of optical diffusion varies continuously between the first diffusion portions and second diffusion portions.

4. The lighting assembly according to claim 1, wherein the diffusor element comprises diffusion particles embedded in a transparent or translucent material, wherein a density of the diffusion particles in the first diffusion portions is higher than a density of the second diffusion portions.

5. The lighting assembly according to claim 1, wherein a thickness of the diffusor element in the first diffusion portions is greater than the thickness in the second diffusion portions.

6. The lighting assembly according to claim 5, wherein the LED elements are arranged along a line at equal distances according to a first pitch, and the thickness varies periodically with a second pitch equal to the first pitch.

7. The lighting assembly according to claim 5, wherein a bottom surface of the diffusor element oriented towards the LED lighting elements has an undulating shape, and a top surface of the diffusor element, arranged opposite of the bottom surface, has a plane shape.

8. The lighting assembly according to claim 5, wherein the thickness in the first diffusion portions is at least 50% greater than the thickness in the second diffusion portions.

9. The lighting assembly according to claim 1, wherein the LED lighting elements are electrically interconnected by electrical conductors forming a lead-frame.

10. The lighting assembly according to claim 1, wherein a light guide is arranged between the LED elements and the diffusor element.

11. The lighting assembly according to claim 10, wherein the light guide is made from silicone.

12. The lighting assembly according to claim 1, wherein a height, measured from a bottom surface to a top surface of the diffusor is less than a pitch between the LED elements.

13. The lighting assembly according to claim 1, wherein a height, measured from a bottom surface to a top surface of the diffusor element, is less than 1 cm.

* * * * *